United States Patent [19]

Komatsu et al.

[11] 4,337,696

[45] Jul. 6, 1982

[54] PRINTING APPARATUS

[75] Inventors: Fumito Komatsu, Shiojiri; Tadashi Kamijima, Shimosuwa, both of Japan

[73] Assignee: Kabushiki Kaisha Sankyo Seiki Seisakusho, Nagano, Japan

[21] Appl. No.: 177,964

[22] Filed: Aug. 14, 1980

[30] Foreign Application Priority Data

Apr. 17, 1980 [JP] Japan ..... 55-50628

[51] Int. Cl.[3] ..... B41J 3/08

[52] U.S. Cl. ..... 101/93.04; 400/121

[58] Field of Search ..... 400/121, 125, 163.1-163.3, 400/617; 101/93.04, 93.23, 93.25, 93.47; 346/101

[56] References Cited

U.S. PATENT DOCUMENTS

| | | | |
|---|---|---|---|
| 1,520,089 | 12/1924 | Scherbius | 400/163.2 X |
| 1,971,859 | 8/1934 | Knutsen | 101/93.25 |
| 3,973,488 | 8/1976 | Mielke | 101/93.04 X |
| 4,046,246 | 10/1976 | Kondur | 400/617 X |

*Primary Examiner*—Paul T. Sewell

*Attorney, Agent, or Firm*—Sughrue, Mion, Zinn, Macpeak & Seas

[57] ABSTRACT

A novel printing apparatus comprises a single drive motor, rotational drive force reduction gears, a drive gear fixedly mounted on a rotary shaft and normally rotated by the drive motor through reduction gears, a base frame rotatably support the rotary shaft, a swingable support plate swingably supported to the rotary shaft, a printing drum rotatably supported to the swingable support plate and threadedly engaged with the drive gear, printing web feeding means for feeding printing web to face the drum, biasing means for biasing the printing drum in the direction opposite to the fed printing web, and novel forcible stopping means for preventing the drum to rotate around its own axis to thereby allow the drum to rotate around the rotary shaft against the biasing means while engaging with the drive shaft.

8 Claims, 12 Drawing Figures

PRINTING APPARATUS

BACKGROUND OF THE INVENTION

The present invention relates to a printing apparatus for printing marks such as letters and figures on printing webs such as papers.

There has been heretofore provided a so-called printer for printing letters, figures and the like on materials such as printing papers. In such a prior art printing machine, a printing drum is driven by a suitable motor to align in printing positions the letters and the like to be printed and then a hammer disposed on an opposite side to the printing drum is driven by solenoid means to hit the drum thereby completing the print on the printing papers positioned between the hammer and the drum.

However, the prior art printing apparatus requires the motor to rotate the printing drum and also the solenoid means having a large capacity enough to drive the hammer. Accordingly, the apparatus is disadvantageous in that the structure thereof is intricate with a large size and a large amount of an electrical power is required to drive the solenoid means.

In order to eliminate such defects, an improved printing apparatus has been proposed in U.S. patent application Ser. No. 147,655 filed on May 7, 1980 and entitled "Printing Apparatus." In this printing apparatus, a printing drum to which a rotational torque from a rotational drive means is normally applied is arranged so as to face to a printing web, and a lever swingable against the printing web suitably supported by a roller rotatably carries the printing drum, and a forcible stopping means serves to prevent the rotation of the printing drum around its own axis whereby the lever can be rotated toward the printing web. According to such a printing apparatus, it is essentially possible to control both the rotation of the printing drum and the printing operation by a single motor. The printing apparatus is, therefore, simple in construction and small in size. Moreover, a small capacity is required for the solenoid means since the solenoid means only serves to rotate a stop lever at a small angle. For this reason, energy consumption may be reduced.

However, such a printing apparatus has the following disadvantages due to the fact that the forcible stopping means includes a ratchet wheel provided to the printing drum and the ratchet teeth ride over the projected stop lever to thereby carry out the printing operation. That is, it is difficult to effectively apply the generated drive force in the printing web direction during the ride-over of the ratchet teeth.

More specifically, the load applied to the motor is increased, which shortens the service life of the motor. Since a large amount of brake force is required for the forcible stopping means, the mechanical strength of the forcible stopping means must be enhanced, which results in the engagement of the apparatus. Also, since the stroke of the printing drum cannot be elongated beyond the ratchet tooth height, it is difficult to adjust the impact timing of the printing drum against the printing web. Furthermore, since the printing drum is rotated around its own axis to carry out the printing, the printing displacement tends to take place. It is also impossible to enhance the printing speed more than a predetermined value. Therefore, a main object of the present invention is to overcome the above-noted defects.

SUMMARY OF THE INVENTION

It is an object of the present invention to provide a printing apparatus in which a sufficient printing ability may be obtained with a small capacity solenoid.

It is another object of the present invention to provide a printing apparatus in which durability of a single motor used therein is enhanced.

It is still another object of the present invention to provide a printing apparatus in which no printing displacements are incurred.

It is still another object of the present invention to provide a printing apparatus operable at high speed.

It is still another object of the present invention to provide a printing apparatus in which a stroke of a printing drum can be established arbitrarily whereby a suitable printing impact timing may be readily determined.

These, as well as other object, are met by providing a printing apparatus comprising a motor producing a rotational drive torque, torque transmission gear, a drive wheel fixedly mounted on a rotary shaft and driven by the rotation drive torque though the torque transmission gear, said drive wheel being rotated in one direction, a base frame rotatably supporting the rotary shaft, a swingable support plate swingably supported to the rotary shaft, a printing drum rotatably supported to the swingable support plate and having at one end a first circumferential torque transmission part engaged with said drive wheel, printing web feeding means for feeding a printing web so as to face the circumferential surface of said printing drum, biasing means for biasing said printing drum in the opposite direction to the printing web to be fed, and forcible stopper means for selectively preventing said printing drum to rotate around its own axis.

DESCRIPTION OF THE PREFERRED EMBODIMENTS

Figure 1:
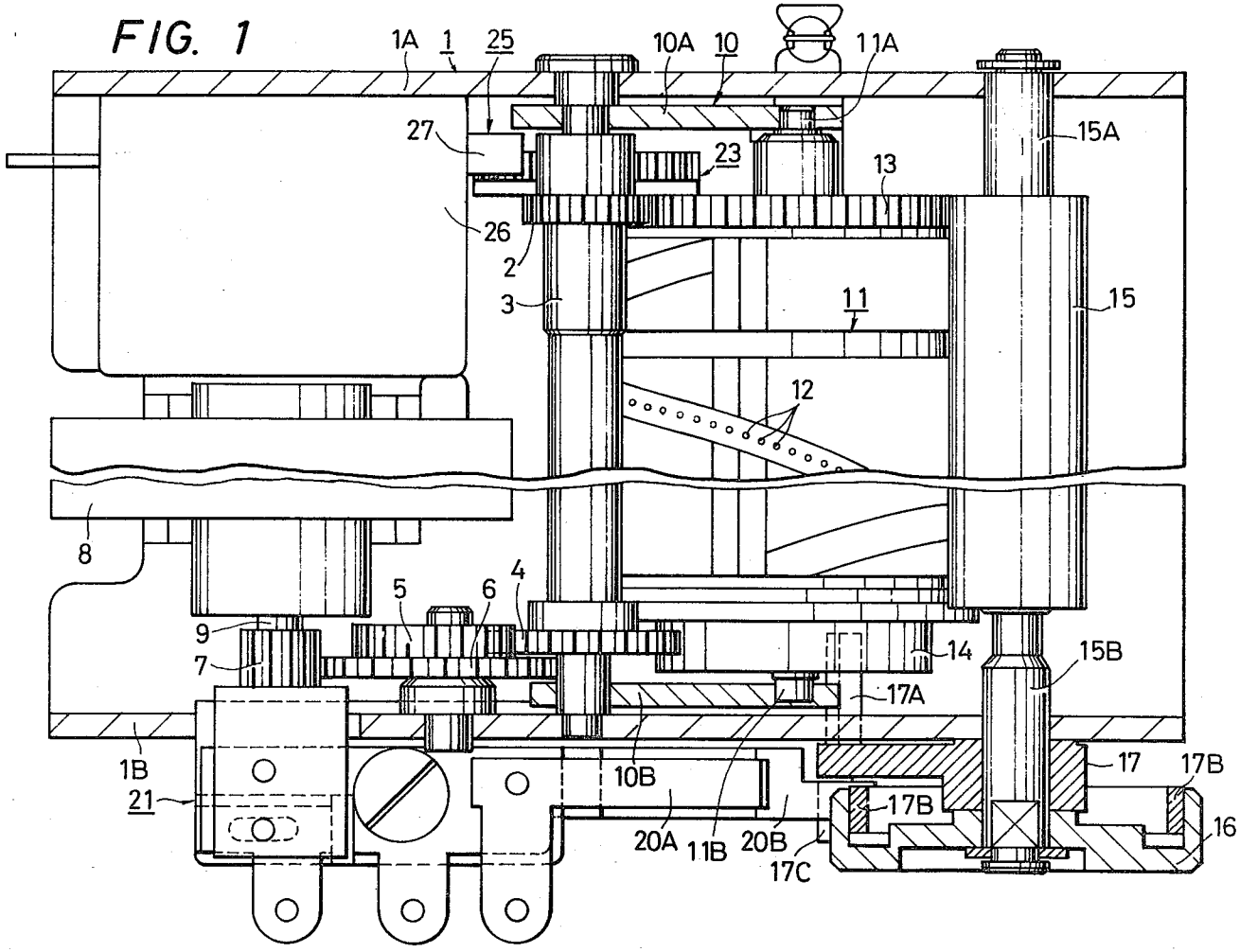
FIG. 1 is a fragmentary partial cross sectional view taken along a line I—I of FIG. 2, of the printing apparatus according to the present invention.
Figure 2:
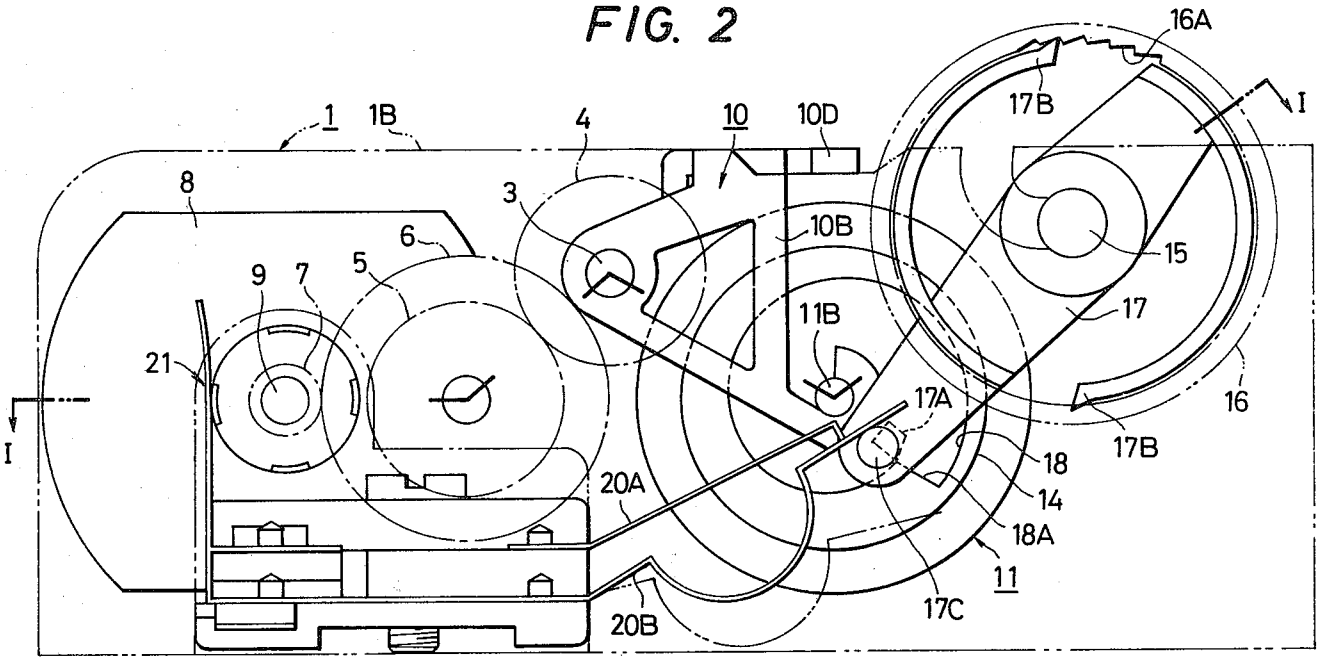
FIG. 2 is a schematical side view of the printing apparatus according to the present invention.
Figure 3:
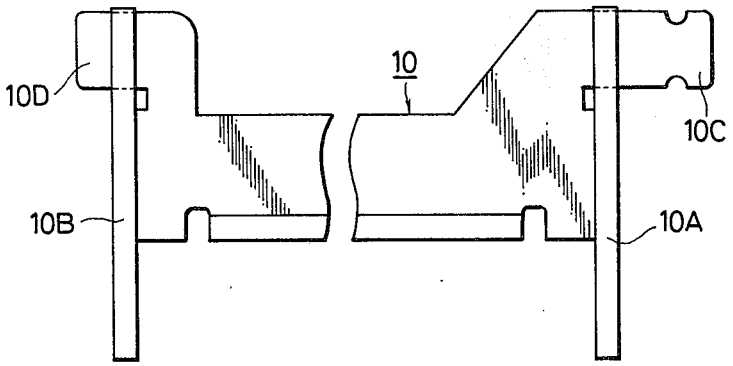
FIG. 3 is a plan view of the swingable support plate used in the printing apparatus.

The present invention will now be described in detail in reference to the accompanying drawings.

In FIGS. 1 to 5 inclusive, reference numeral 1 generally designates a frame body having upright walls 1A and B to which a drive shaft 3 made of plastics and having a drive gear wheel 2 is rotatably supported at both ends. The drive shaft 3 is connected to an output shaft 9 of a motor 8 as a drive source through a well known gear reduction mechanism including gears 4, 5, 6 and 7.

Figure 4:
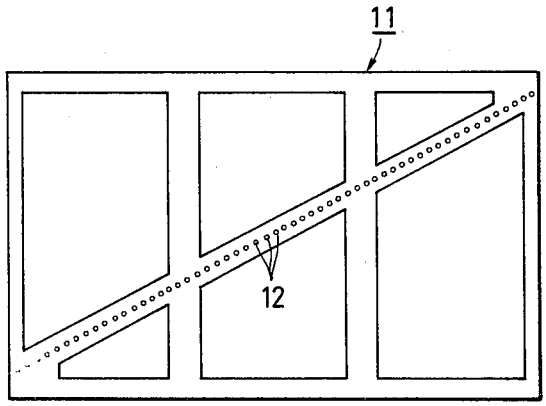
FIG. 4 is an exploded view of the printing drum used in the printing apparatus.

A swingable drum support means 10 including a pair of side plates 10A and B is pivotably supported also to the rotary shaft 3. A pair of shafts 11A and B of a printing drum 11 are rotatably supported to the side plates 10A and B, respectively. A number of printing dots or projections are arranged in a helical manner on an outer circumferential surface of the drum 11 as best shown in FIG. 4 which is an exploded view of the printing drum 11. A gear wheel 13 which is normally engaged with the drive gear wheel 2 is integrally provided at one end of the printing drum 11. At the other end of the printing drum 11 is provided a cam member 14 having a suitable cam surface 18 in its interior.

A paper feeding roller 15 made of rubber or the like is provided at a suitable distance to face the printing drum 11. A pair of shafts 15A and B of the paper feeding roller 15 are also rotatably supported to the upright walls 1A and B.

A paper feeding wheel 16 is fixedly secured to the shaft 15B of the paper feeding roller 15. A paper feeding lever 17 is also rotatably supported to the shaft 15B in contact with the inner surface of the paper feeding wheel 16. The paper feeding level 17 has at its free end a slide piece 17A which slidingly contacts with the inner cam surface 18 of the cam member 14. In every rotation of the printing drum 11, the paper feeding lever 17 is swung and elastic claws 17B formed on the paper feeding lever 17 are engaged with inner ratchet teeth 16A formed in the paper feeding wheel 16 to thereby intermittently rotate the paper feeding wheel 16 by one pitch in the clockwise direction shown in FIG. 2. Accordingly, a printing web or paper A is intermittently fed by the feeding direction shown in FIG. 5. Reference numeral 19 denotes a guide member for guiding the fed paper suitably. A pair of switching pieces 20A and B are adapted to detect a shouldered portion 18A of the cam surface 18 to thereby produce an original position signal. The switching piece 20B resiliently pushes a projection extending 17C from the paper feeding lever 17 to bias the projection counterclockwise and to normally bias the slide plate 17A toward the cam surface 18.

Switch means 21 is provided to the output shaft 9 of the motor 8. In the specific embodiment shown, four pulses are produced in every rotation of the output shaft 9, and the printing drum 11 is once rotated by every fourteen rotations of the output shaft 9 through the reduction gear mechanism 4, 5, 6 and 7. The reduction gear ratio is predetermined to satisfy such a condition. Accordingly, when the printing drum 11 is once rotated, 56 pulses will be generated by the switch means 21. The number (56) of the pulses is identical with the number of printing dots 12 formed on the printing drum 11. Therefore, the number of the pulses is counted from a moment when the switch piece 20B is separated from the switch piece 20A to generate the pulses whereby the respective dot 12 positions in the printing drum 11 can be indicated.

The printing drum 11 is biased to move remotely from the printing paper A while rotated on the shaft 3 by the force of a spring 22 in addition to the gravitational forces of the printing drum 11 itself, the support plate 10 and the like. The maximum interval between the printing paper A and the printing drum 11 is restricted by abutment of extension 10C and D of the swingable support plate 10 against the upright walls 1A and B.

A ratchet wheel 23 is rotatably supported to the swingable support plate 10 and is coaxially and integrally provided with a gear wheel 24 which is normally engaged with the gear wheel 13 of the printing drum 11.

Forcible stopper means 25 will now be described. The forcible stopper means 25 includes a solenoid 26 mounted on the frame body 1 and a stop 27 retractable by the solenoid 26 and engageable with one slant surface of each ratchet gear tooth 23A. The stopper 27 is usually retracted separating from the ratchet teeth 23A. The stopper 27 is projected by the magnetic force of the solenoid 26 to engage with one rachet tooth when the solenoid 26 is energized, thereby stopping the rotation of the printing drum 11.

Figure 5:
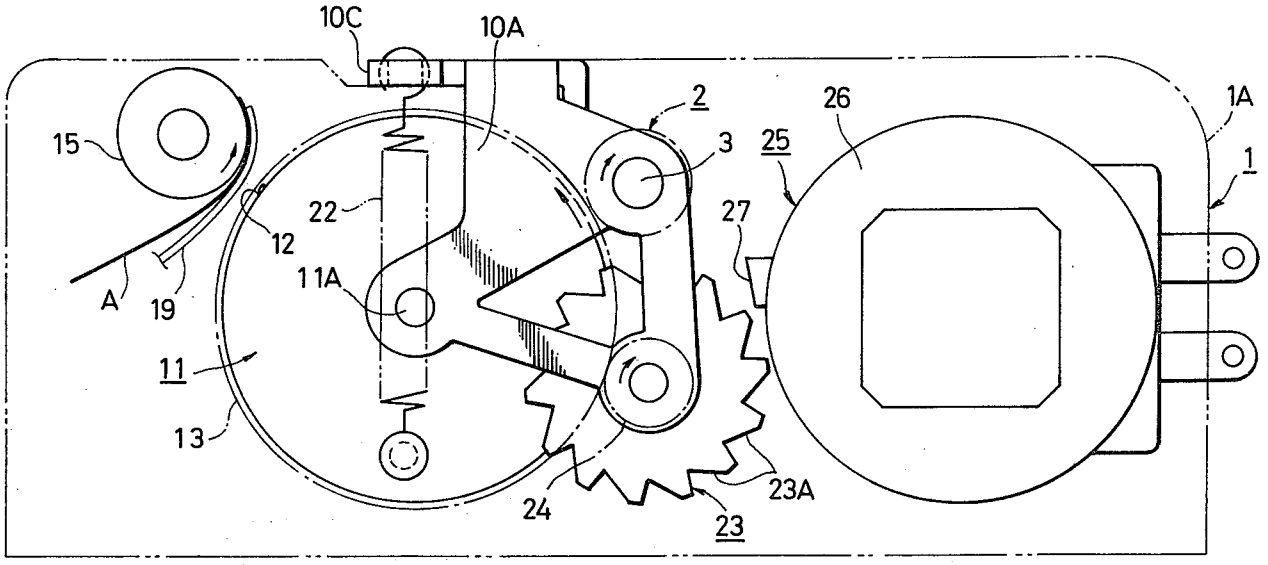
FIG. 5 is another schematical side view of the printing apparatus.

The rotational direction of the drive gear wheel 2 is a direction in which the drive gear wheel 2 and the printing drum 11 undergo a sun-and-planet motion while the printing drum 11 is not rotated around its own axis to thereby advance the printing drum 11 toward the paper surface A, that is, a counterclockwise direction in FIG. 5.

With the thus constructed printing apparatus, the stopper 27 is usually separated from the ratchet teeth 23A. When the motor 8 operates, the printing drum 11 is rotated counterclockwise (in FIG. 5) at a position remote from the printing paper A and the ratchet wheel 23 is rotated clockwise (in FIG. 5). At the same time, the paper feeding roller 15 is rotated to feed the printing paper A by one pitch in every one rotation of the printing drum 11.

Figure 6:
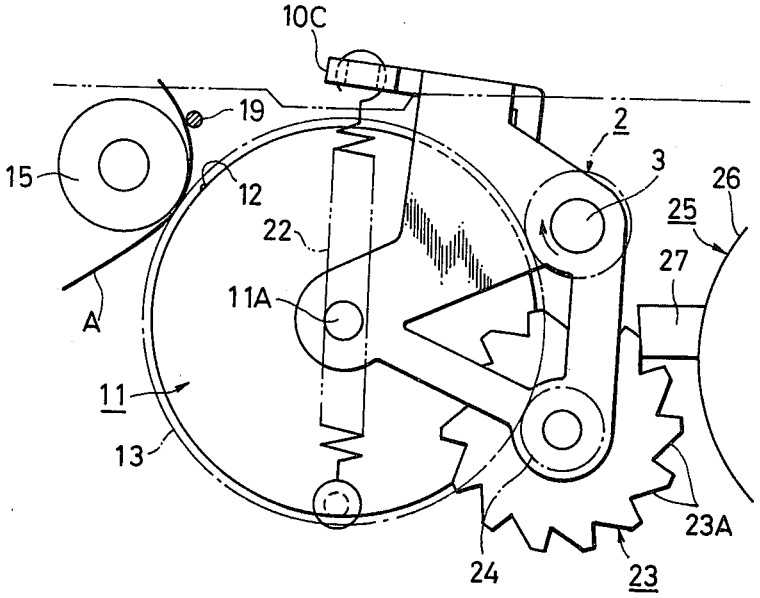
FIG. 6 is an illustration showing another state of the printing apparatus.

When a signal for printing a predetermined a sign or mark such as a figure and a letter is transmitted to a control circuit (not shown), the number of the pulses out of the switch means 21 is counted from a moment when the switch piece 20B is separated from the switch piece 20A to generate the signal. Then, after the predetermined number of the pulses is counted, the solenoid 26 is driven to project the stop 27 thereby abutting against the ratchet tooth 23A. As a result, the ratchet wheel 23 is not rotated around its own axis and at the same time the printing drum 11 is not rotated around its own axis. Accordingly, the printing drum 11 is rotated together with the swingable support plate 10 around the drive gear wheel 2 toward the printing paper A to complete a planet-motion so that the dot 12 corresponding to the number of pulses is impacted against the printing paper A as shown in FIG. 6. The angular speed of the printing drum 11 during the planet-motion is equivalent to the angular speed of the drive gear wheel 2. For this reason, one action of the printing apparatus is quickly achieved.

The solenoid 26 is turned off after a lapse of time required for printing, and the stop 27 is retracted by a force of a spring or the like (not shown) to be separate from the ratchet tooth 23A, and the printing drum 11 is returned to the original position at a predetermined interval to the printing paper A. Then the printing drum 11 and the ratchet wheel 23 are again rotated around their own axes, respectively.

Figure 7:
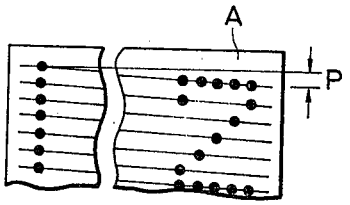
FIG. 7 is an example of the printed marks obtained according to the present printing apparatus.

As shown in FIG. 7, during one pitch P of the paper A, the printing is carried out by the desired dot or dots 12. With the repeated actions of the printing apparatus, a predetermined letter or a figure is printed.

Figure 8:
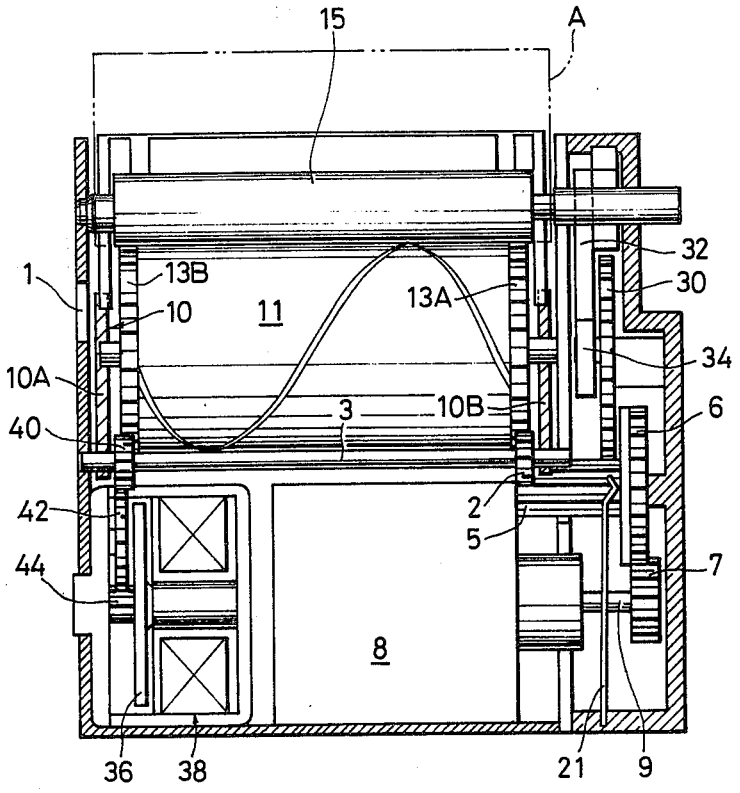
FIG. 8 is a schematical partial cross sectional view of another printing apparatus according to the present invention.

Another embodiment of a printing apparatus according to the present invention will now be described with reference to FIGS. 8 to 11 inclusive. FIG. 8 shows a printing apparatus in which the same reference numerals or characters are used to designate like members used in the preceding embodiment. In this embodiment, modified paper feeding mechanism and forcible stopper means are employed.

A printing drum 11 having a gear 13A at one end is adapted to be rotated by a motor 8 through reduction gear mechanism 5, 6 and 7 and a drive gear 2 which is rotatably provided at one end of a drive shaft 3 fixedly supported to upright walls 1A and B of the frame body. The drum 11 is supported rotatably to a pair of side walls 10A and B of a swingable drum support means 10.

Figure 9:
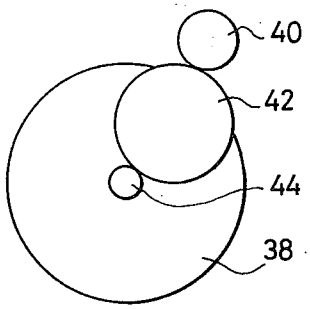
FIG. 9 is a schematical illustration showing a gear engagement concerning the solenoid brake.
Figure 10:
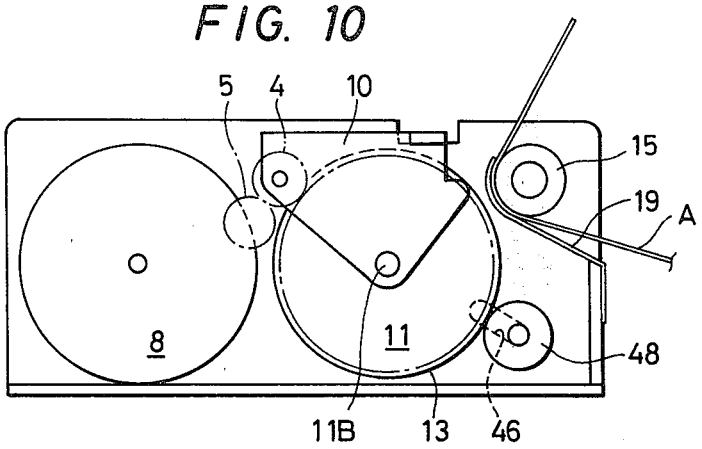
FIG. 10 is a schematical side view of the printing apparatus shown in FIG. 9.

At the other end of the drive shaft 3 is provided a gear 40 which is freely rotatable to the drive shaft 3 but is not displaced in the axial direction of the drive shaft 3. The gear 40 is normally engaged with a gear 13B formed at the other end of the printing drum 11 and also always engaged with a gear wheel 42 meshing with a gear 44 of a solenoid brake 38 as schematically shown in FIG. 9. A friction disc 36 is fixed to the gear 44 and is drawn by the magnetic force of the solenoid so that a braking force is applied to the gear 44. Thus, the forcible stopper means includes a simple solenoid brake to allow the drum 11 to rotate around the drive shaft 3 to thereby impulse the drum 11 against the paper A supported by a paper feeding roller 15. In the same manner as in the previous embodiment, the drum is biased to move downwardly by the gravitation and spring biasing means (not shown). It is obvious that in the printing apparatus shown in FIGS. 8 to 12 no mechanical noise due to the solenoid is generated because of the solenoid brake means and a rather small mechanical strength is required to the solenoid brake means.

Figure 11:
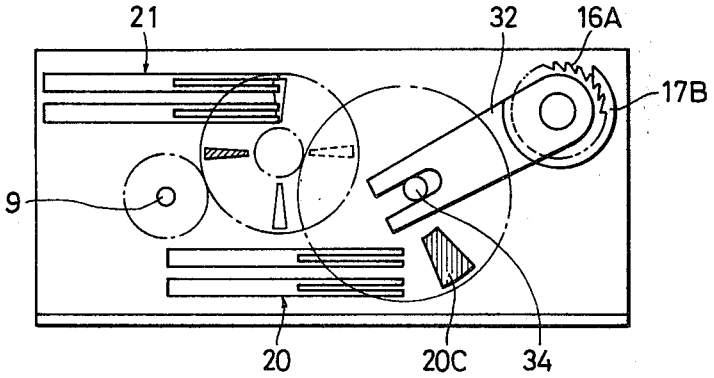
FIG. 11 is another schematical side view of the printing apparatus shown in FIG. 10.

In the embodiment shown in FIGS. 8 to 12, there is provided an independent paper feeding mechanism including a gear wheel 30 meshing with the gear 5, an eccentric pin 34 implanted in the wheel 30, a bifurcated lever 32 rotatably supported to the shaft of the paper feeding roller 15, and ratchet wheel 16A. As shown in FIG. 11, the eccentric pin 34 is slidingly clamped by the bifurcated portions of the lever 32. A resilient claw 17B fixed to the bifurcated lever 32 is engaged with one ratchet tooth of the ratchet wheel 16A fixed to the paper feeding roller 15. Reference numerals 20 and 21 denote switching means as used in the preceding embodiment. An ink roller 48 is provided along a groove 46.

Figure 12:
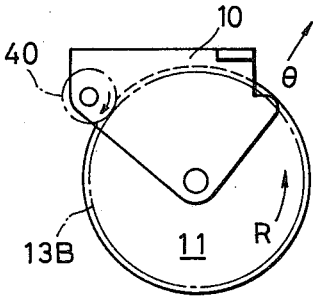
FIG. 12 is an illustration of operation of the apparatus shown in FIG. 10.

The paper feeding mechanism will operate as follows. When the motor 8 is driven, a drive torque in the direction R indicated in FIG. 12 is transmitted to the printing drum 11 from the driving gear 2 which engages with the gear 13A of the printing drum 11 and coaxially provided with the gear 40 on the shaft 3. When the frictional disc 36 is stopped by the absorption force of the solenoid brake 38, the printing drum 11 is swingingly rotated around the gear 40 in the direction Q indicated also in FIG. 12. This motion is that the gear 40 serves as a sun-gear and the drum 11 as planet-gear. Simultaneously, the rotational torque is transmitted through the reduction gear mechanisms 7, 6 and 5 to the gear wheel 30 so that the bifurcated lever 32 is rotated in engagement with the eccentric pin 34. Then, the resilient claw 17B advances the ratchet wheel 16A by one pitch to thereby feed the paper A by one pitch. Thus, the paper feeding mechanism operates synchronizing with the printing drum 11.

As described above, in this embodiment, the paper feeding mechanism is not operatively engaged with the printing drum but directly engaged with the drive gear 5 so that an excessive force is not applied to the printing drum 11. In addition, it is advantageous that the eccentric pin 34 is used in order to dispense with spring biasing means.

The present invention is described on the basis of the two specific embodiments but is not limited thereto. Various modifications may be used.

While in the specific embodiment, the gravitational forces due to the printing drum, the drum supporting plates and the like and the spring biasing means are used, as means for separating the printing drum from the paper, it is obvious to use only the gravitational force without the spring biasing means. The solenoids, the stopper and the like constituting the forcible stopper means may be formed onto the drum supporting means. If the rotation of the printing drum around its own axis is stopped, any modification may be used. For example, without the ratchet means, means for directly stopping the rotation of the printing drum around its own axis may be used.

What is claimed is:

1. A printing apparatus comprising;

a motor producing a rotational drive torque, torque transmission means, a drive wheel fixedly mounted on a rotary shaft and driven by the rotation drive torque through said torque transmission means, said drive wheel being rotated in one direction, a base frame rotatably supporting said rotary shaft, a swingable support plate swingably supported to said rotary shaft, a printing drum rotatably supported to said swingable support plate and having at one end a first circumferential torque transmission part engaged with said drive wheel, printing web feeding means for feeding a printing web so as to face the circumferential surface of said printing drum, said printing web feeding means having a rotational axis parallel to the rotational axis of said printing drum, biasing means for biasing said printing drum in the opposite direction to the printing web to be fed, and forcible stopping means for selectively preventing said printing drum from rotating around its own axis, and to simultaneously effect printing, said one direction of rotation of said drive wheel being determined such that, when said forcible stopping means is operative to prevent rotation around the axis of said printing drum caused by rotational torque transmitted from said drive wheel, said printing drum is rotated around only said rotary shaft toward said printing web in a sun-and-planet motion to effect printing by rotational torque transmitted from said drive wheel.

2. A printing apparatus as defined in claim 1, wherein a said drive wheel has a circumferential gear.

3. A printing apparatus as defined in claim 1 or 2, wherein said biasing means is a resultant gravitational force of the printing drum and the swingable support plate.

4. A printing apparatus as defined in claim 1, said forcible stopping means includes a plunger driven by solenoid means.

5. A printing apparatus as defined in claim 4, wherein said forcible stopping means includes a ratchet wheel normally rotated with said printing drum, and said plunger is selectively engageable with said ratchet wheel, rotation of said ratchet wheel being stopped upon operation of said solenoid means.

6. A printing apparatus as defined in claim 1, wherein said forcible stopping means includes a solenoid brake means.

7. A printing apparatus as defined in claim 1, wherein said paper feeding means includes a paper feeding lever engaged with a cam means operatively synchronizing with the printing drum, said cam means being driven by the drive torque transmitted through another torque transmission means.

8. A printing apparatus as defined in claim 7, wherein said cam means includes an eccentric pin and bifurcated portions formed at one end of the paper feeding lever, said eccentric pin being slidingly clamped by said bifurcated portions.

* * * * *